United States Patent [19]

Eddy

[11] 4,003,777

[45] * Jan. 18, 1977

[54] METHOD OF FORMING A LAMINATED STRUCTURE

[76] Inventor: Robert G. Eddy, 20 Casablanca Court, Elnora, N.Y. 12065

[ * ] Notice: The portion of the term of this patent subsequent to Feb. 9, 1988, has been disclaimed.

[22] Filed: Sept. 8, 1975

[21] Appl. No.: 610,924

Related U.S. Application Data

[63] Continuation of Ser. No. 416,247, Nov. 15, 1973, abandoned, and a continuation-in-part of Ser. No. 667,181, Sept. 12, 1967, Pat. No. 3,562,043.

[52] U.S. Cl. ..... 156/246; 156/82; 156/148; 156/290; 156/306; 156/324; 260/2.5 AE; 260/2.5 BE; 260/2.5 M; 264/45.6; 428/262; 428/323; 428/904

[51] Int. Cl.[2] ..... B29D 7/02

[58] Field of Search ..... 156/79, 82, 231, 238, 156/241, 247, 290, 324, 148, 306, 246; 264/45.4, 45.6; 260/2.5 AE, 2.5 BE, 2,5 M; 428/262, 323, 904

[56] References Cited

UNITED STATES PATENTS

| | | | |
|---|---|---|---|
| 2,722,495 | 11/1955 | Hedges | 156/321 |
| 3,562,043 | 2/1971 | Eddy | 156/79 |
| 3,634,184 | 1/1972 | Wang | 428/262 |
| 3,832,214 | 8/1974 | Wang | 427/296 |

*Primary Examiner*—Edward G. Whitby
*Attorney, Agent, or Firm*—Darby & Darby

[57] ABSTRACT

A method of forming a laminated structure in which an outer layer of hardenable material and a carrier layer are respectively bonded to opposite faces of a preformed substantially shape-retaining barrier layer. The face of the carrier layer to which one of the opposite faces of the barrier layer is bonded is formed with projecting and recess portions and the barrier layer is bonded thereto in such a manner so as to adhere substantially only to the projecting portions without filling the recess portions. For instance, when the carrier layer is formed from a sheet of woven or knitted textile material, the barrier layer will adhere only to portions of the yarns or threads at the one face of the sheet substantially without filling the interstices between the threads. Evidently, the hardenable material of the outer layer will also not penetrate into the interstices, due to the interposition of the barrier layer between the outer and the carrier layer, even if the material of the outer layer is applied in flowable condition or in liquid form to the preformed barrier layer so that the laminated structure produced will be very pliable.

8 Claims, 7 Drawing Figures

METHOD OF FORMING A LAMINATED STRUCTURE

CROSS-REFERENCE TO RELATED APPLICATION

This is a continuation of application Ser. No. 416,247, filed Nov. 15, 1973, now abandoned and a continuation-in-part application of the copending application Ser. No. 667,181, filed Sept. 12, 1967 now U.S. Pat. No. 3,562,043.

BACKGROUND OF THE INVENTION

The present invention is concerned with the method of forming a laminated structure best exemplified by a textile sheet carrying on one face thereof a layer which may be porous and which may serve to simulate leather. Such structures are produced by coating a substrate such as a textile sheet with a latently foamable mass, for instance with a polyvinylchloride plastisol having a blowing agent incorporated therein, and by solidifying the plastisol layer and activating the blowing agent, a more or less leatherlike layer was formed on the substrate.

However, to proceed in this manner is connected with several disadvantages. The plastisol or the like, upon being applied to the textile sheet will tend to fill the interstices thereof and also to enter the capillaries of the textile fibers. This will not only increase the consumption of the material applied to the textile material, but will also cause locking of the textile material so that the final product will not possess the desired flexibility.

SUMMARY OF THE INVENTION

It is an object of the present invention to overcome these difficulties and disadvantages and to provide for a method of forming a laminated structure which includes an outer layer of possibly leather-like appearance, and a carrier layer such as a sheet of textile material or the like in which the laminated structure produced has a high flexibility.

The method according to the present invention of forming a laminated structure mainly comprises the steps of pre-forming a substantially shape-retaining barrier layer having opposite faces, bonding to one of the opposite faces an outer layer of hardenable material, bonding to the other of the opposite faces one face of a carrier layer provided with projecting and recess portions in such a manner that the barrier layer will adhere to the projecting portions substantially without filling the recessed portions. The aforementioned steps may be carried out in any desired sequence and the hardenable layer is hardened latest at the time of bonding the same to the intermediate layer.

In the parent application there is mentioned an example in which the barrier layer is formed from polyurethane and this material may also be used for forming the outer hardenable layer.

These polyurethane materials possess an inherent rate of heat conductivity and moisture vapor transmissivity, which imparts a more or less leather-like comfort factor which is a desirable characteristic of the laminated structure produced according to the present invention, especially when this structure is used for apparel, shoes, upholstery and like application. If the hardenable outer layer is formed from a moisture curing type of polyurethane, a definite cellular structure can result from emission of $CO_2$ upon reaction of NCO groups of an isocyanate component, within the liquid polyurethane prepolymer, with water, under properly controlled conditions of reaction and hardening in the presence of moisture.

Additionally lacquers of solvent soluble, fully reacted polyurethanes, liquid phase amide extended polyurethanes, solvent solution prepolymers of the two component type for reaction of an isocyanate adduct with OH groups of polyol and/or with moisture ($H_2O$) and even combinations of polyurethanes with solvent solutions of acrylic or nylon resins are also useful and form good films of relatively high moisture transmissivity and supple leather-like character upon hardening.

All these liquid polyurethane materials are applicable to preformation of the "barrier layer" required by the method according to the present invention, and may also be used in another phase of the manufacturing process to form the required, compatible "hardenable liquid layer".

Melt calendar coating or blow extrusion may be used for the production of the necessary preformed barrier layer. This is, however, limited to the use of fully thermoplastic polyurethanes for this barrier layer.

Excellent results may also be had by the use of the other, above-cited, lacquers and reactive polyurethanes in liquid, coatable form. Some of these materials are only partially thermoplastic or temporarily thermoplastic and, therefore, are not adaptable to melt calendar or extrusion processing, but otherwise, possess superior characteristics for resistance to chemical or solvent attacks, hydrolysis, light stability, etc.

When the above-cited hardenable liquid polyurethanes or similar liquid coatings are used for preformation of the "barrier layer", it is necessary to support the liquid film until the latter is transformed into the substantially shape-retaining barrier layer, and the liquid film may be supported on a temporary support which may be constituted by an endless release surfaced belt or, preferably, on a released surfaced paper an elongated flat portion of which between a supply roll and a rewinding roll is held in taut condition to support the liquid film thereon until it is formed into a shape-retaining barrier layer and until at least one of the other two layers is bonded thereto.

According to the present invention not only the shape-retaining barrier layer may be produced from a film of liquid material by drying or hardening the same on a temporary support, but also the outer layer of hardenable material may be produced in this manner by supporting a liquid film of appropriate material on a temporary support.

Depending on the sequence in which the various operations are carried out, it is also possible to support the liquid film from which the barrier layer is to be produced on the outer layer, or vice versa, but evidently the liquid film from which the barrier layer is to be produced can not be applied to the carrier layer before this liquid film is formed into a substantially shape-retaining layer since it is essential according to the present invention that the material of the barrier layer does not saturate the material of the carrier layer.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
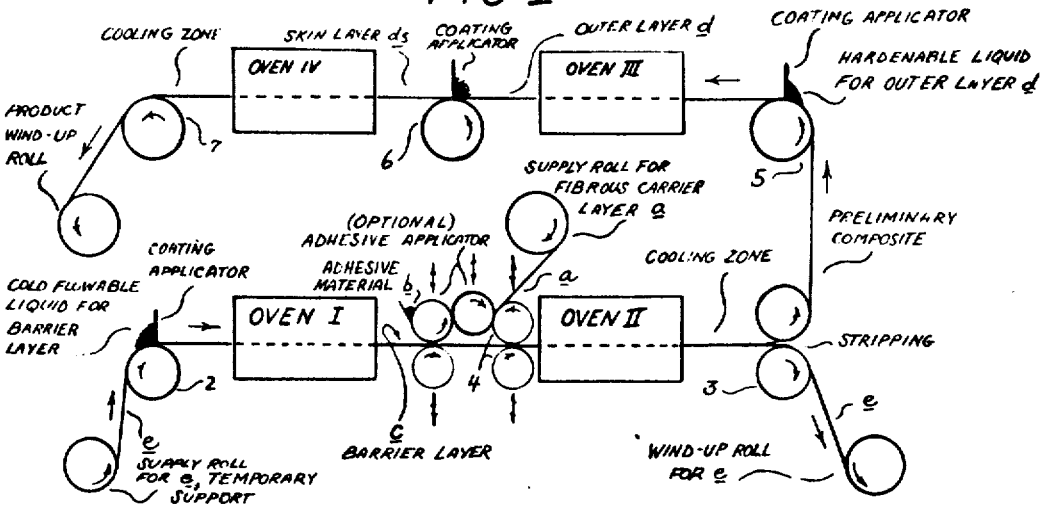
FIGS. 1–6 are schematic elevational views of arrangements for carrying out tne method according to the present invention.

As pointed out above, an outer layer of hardenable material and a carrier layer of fibrous material are bonded to opposite faces of a barrier layer sandwiched between the outer and the carrier layer whereby the face of the carrier layer which is bonded to the barrier layer is provided with projecting and recessed portions corresponding to the yarn structure crowns and interstices therebetween or fibers and capillaries, and the barrier layer is bonded to this face of the carrier layer so as to adhere substantially only to the projecting portions without filling the recessed portions therebetween. As further pointed out above, the steps may be carried out in many different sequences as will be explained in further detail below.

As also pointed out above, the shape-retaining barrier layer and/or the outer layer of hardenable material may be preformed from a liquid film whereby such liquid film may be supported, until the forming thereof into the respective layer and bonding another layer thereto, by a temporary support.

The carrier layer is preferably a textile material such as a woven, knitted or non-woven or felted fabric. In the case of woven fabrics, the same should possess sufficient tensile breaking strength, generally a minimum of 4 g/in in warp and weft direction and in the case of other type of textile materials substantially similar characteristics will be desired. Furthermore, the textile material should have a sufficient resistance to thermal exposure, such as maintenance of the required minimum tensile strength after exposure for 2 minutes to at least 250° F.

Suitable textile materials for forming the carrier layer include those having high and low relative cover factors and high and low air permeability.

Good results are obtained, for instance, with the following type of textile materials.

1. Woven fabrics;
1.21 yard per pound, napped cotton sateen in 58 inches finished width;
2. Warped knitted fabrics;
4.0 yard per pound, 2 bar, 40 denier nylon jersey finished 60 inches wide;
3. Circular knitted fabrics;
2.0 yard per pound, bleached cotton jersey split to 60 inch open width and edge gummed;
4. Non-woven fabrics;
2.0 yard per pound, acrylic latext saturated, random laid, non-oriented nylon fiber structure, 60 inches wide;
5. Felted fabrics;
2.5 yards per pound, 50 inch wide, needle punch random fiber web formed from 3.0 denier, 50/50 blend of high shrinkage and low shrinkage nylon fibers (product finally shrunk and compacted by steam autoclaving);
6. Spun bonded fabrics;
56 inch wide nylon, spun bonded web sold by E. I. DuPont Co. under the trade name "Reemay";
7. Other fibrous combinations;
Any fabric from the above general classifications or specifically;
a 4.0 yard per pound, 2 bar nylon tricot jersey flame laminated to a 1/16 inch thick flexible, apparel grade, polyester-type, polyurethane foam of less than 2.0 lb per cubic feet density, finish trimmed to 56 inch width.

The above-mentioned specific samples are given in a non-limiting sense.

If the barrier layer or the outer layer are formed from a liquid film, the following materials may be used for the liquid film from which the outer layer or the barrier layer will be produced:

---

Liquid Materials from which the shape-retaining barrier layer and/or the outer layer may be formed.

---

A. Resins in Solvent Solution
1. Fully Reacted Polyurethanes - One Component Type
(a specific example amongst many formulation possibilities):
parts by weight
22.0 "Estane" 5707 F, a polyurethane by B. F. Goodrich
0.1 "Irganox" 1076, an antioxidant by Geigy
17.0 Acetone, a solvent or diluent
12.0 MEK, methylethylketone - a solvent
31.0 DMF, dimethylformamide - a solvent
6.0 THF, tetrahydrofuran - a solvent
2. Polyester
(a specific example amongst many formulation possibilities which are applicable)
parts by weight
8.0 "Vitel" 1200, a Goodyear resin
4.0 "Vitel" 222, a Goodyear resin
30.0 MEK, methylethylketone
20.0 toluene
3. Acrylic
(a specific example amongst many formulation possibilities which are applicable)
parts by weight
18.0 "Acryloid" 101A, a Rohm and Haas resin
6.0 "Acryloid" 55D42, a Rohm and Haas resin
60.0 MEK, methylethylketone, a solvent
4. Vinyl
(a specific example amongst many formulation possibilities which are applicable)
parts by weight
10.0 VYNS, a Union Carbide Corp. resin
15.0 VYHH, a Union Carbide Corp. resin
1.0 DOP, dioctylphthalate - a plasticizer
75.0 MEK, methylethylketone - a solvent
5. Nylon
(a specific example amongst many formulation possibilities)
parts by weight
20.0 "Elvamid", an E. I. DuPont Co. resin
22.0 $H_2O$, water
58.0 Methyl alcohol B. Reactive Prepolymers and Cross-Linkable Polymers in Solvent Medium
1. Polyurethane - a multi-component type
(such as a resin pre-polymer, an isocyanate adduct and an accelerator in solvent solution)
(an example amongst many formulation possibilities)
parts by weight
100.0 Daltoflex IS, I.C.I. America, Inc.
15.0 SUPRASEC G, I.C.I. America, Inc.
12.5 SURPASEC KN, I.C.I. America, Inc.
50.0 MEK, methylethylketone
100.0 Ethyl Acetate
2. Acrylic - cross-linkable type, thermosetting resin.
parts by weight
64.0 "Acryloid" B-44, Rohm and Haas resin
47.0 "Acryloid" AT-56 Rohm and Haas resin
23.0 "Uformite" MM47, Rohm and Haas
20.0 MIBK, methylisobutylketone
3.0 HCl, hydrochloric acid 1 N C. Resin Emulsions and Lattices
1. Vinyl/Acrylic
parts by weight
.0 "Rhoplex" E-358, Rohm and Haas, acrylic -continued

| Liquid Materials from which the shape-retaining barrier layer and/or the outer layer may be formed. | |
|---|---|
| 80.0 | "Geon" 103, B. F. Goodrich, vinyl |
| 2. Acrylic | |
| parts by weight | |
| 10.0 | CR-483, Rohm and Haas |
| 100.0 | E-358 Rohm and Haas |
| 0.5 | DF-160-L, Nopco Chemical Co. |
| 2.0 | ASE-95, Rohm and Haas |
| 3. Polyurethane | |
| 100 parts | Wyandotte Chem. Corp. fully reacted high molecular weight urethane lattice in aqueous emulsion |

Any of the above liquid materials or even others may be used for forming the shape-retaining barrier layer in the processes as described below in connection with FIGS. 1, 2 and 4, and for forming the outer layer in the processes as described below in connection with FIGS. 1, 2, 3, 5 and 6.

It is, however, also possible to use in the process according to the present invention, as will be described later on in detail, an already pre-formed barrier layer, and in this case a pre-formed 1/64 to ½ inch thick polyurethane foam sheet or a polyurethane film of a thickness of 0.0002–0.008 inch may be used. As specific examples amongst many applicable possibilities, the following materials are mentioned:

a. a 1/16 inch thick, pre-formed (by peeling a thin section from a cylindrical bun), a polyurethane foam of the polyester type, of flexible formulation for apparel application, foamed to a density of less than 2.0 lb. per cubic foot having high proportion of non-reticulated cell membranes which accomplish the objectives of the barrier layer, such foam sheet in continuous 60-inch wide roll form is laminated by known flame lamination technique to a fibrous backing material. This type of foam sheet is produced by General Foam Division of Tenneco Chemical Corp. or Crestfoam Corp. and other suppliers;

b. a 0.001 inch thick polyurethane film pre-formed by blow extrusion and wound in a continuous roll of 60 inch width is adhesively laminated to the fibrous backing material. Such polyurethane films are manufactured under the trade name TUFTANE by B. F. Goodrich Chemical Co. and other suppliers.

Such materials for the barrier layer may be used in the process described below in connection with FIG. 3.

If the barrier layer or the outer layer is produced by hot calendering, the following thermoplastic materials may be used:

| | |
|---|---|
| A. Polyurethanes | |
| (a specific example amongst many possible formulation) | |
| parts by weight | |
| 100.0 | "Estane" 58054, B. F. Goodrich Co. |
| 2.0 | Stearic Acid |
| 1.0 | Acrowax |
| B. Polyvinylchloride - PVC | |
| (a specific example amongst many formulations): | |
| parts by weight | |
| 100.0 | Diamond 450, Diamond Shamrock Corp. |
| 53.5 | DOP, dioctylphthalate |
| 4.5 | G-62, Rohm and Haas |
| 1.5 | Ba, Ca, Zn Stabilizer (Advance Chemicals Corp. BC 107 |
| 0.5 | Stearic Acid |
| 20.0 | calcium carbonate filler |
| 10.0 | Pigment paste (6 parts DOP, 4 parts pigment) |

Such materials may be used for the barrier layer in the processed described below in connection with FIGS. 5 and 6 and for the outer layer in the process as described below in connection with FIG. 4.

As mentioned above, the shape-retaining barrier layer and the outer layer may be formed according to the present invention in various different ways and the layers from which the composite laminated product is formed may be applied and bonded to each other in different sequences and accordingly different arrangements will be necessary for carrying out the process of the present invention.

These various arrangements are illustrated in FIGS. 1–6, to which reference is now had.

Referring first to FIG. 1, it will be seen that this Figure illustrates an arrangement or apparatus for carrying out a first process according to the present invention according to which the shape-retaining barrier layer as well as the outer layer are both formed from a liquid film and in which the barrier layer, after forming thereof from the liquid film, is bonded to the carrier layer, whereafter a liquid film from a material forming the outer layer is applied to the free face of the barrier layer.

As shown in FIG. 1, a temporary support *e* is continuously unwound from a supply roll and guided over guide rolls 2 and 3 to a wind-up roll so as to form between the guide rolls 2 and 3 a substantially horizontally extending portion of the temporary support *e*. This temporary support may be formed, for instance, by a polyurethane grade release paper produced by S. D. Warren Co. In the region of the guide roll 2 a cold flowable liquid for forming the barrier layer from a material as specified above is applied to the outer surface of the temporary support *e* by means of a coating applicator so as to form a thin film of this liquid material on the surface of the temporary support. The temporary support with the liquid film thereon is then passed through either a solvent evaporation zone or over I in which the liquid film is transformed into a substantially shape-retaining barrier layer *c*, for instance by evaporating or otherwise removing solvent from the liquid. The fibrous carrier layer *a* is continuously unwound from a supply roll thereof and guided together with the temporary support *e* and the shape-retaining barrier layer *c* through the nip of a pair of rolls 4 or at least over the upper roll 4 so that the barrier layer is applied to one face of the carrier layer and the thus superimposed two layers are passed through the oven II in which the barrier layer is bonded to one face of the carrier layer in such a manner that the barrier layer will adhere substantially only to the projecting portions on this one face without filling the recesses between the projection portions. After leaving the oven II, the preliminary composite thus obtained is stripped from the temporary support *e* and the latter is wound up on the wind-up roll, whereas the mentioned composite is guided upwardly to then pass in substantially horizontal direction over additional guide rolls 5, 6, and 7.

In the region of the guide roll 5 a hardenable liquid coating or film from one of the above-mentioned liquid materials for forming the outer layer *d* is applied by a coating applicator to the outer surface of the barrier layer *c*, whereafter the composite is passed through the oven III in which the liquid film forming the outer layer is hardened and bonded to the outer face of the barrier layer. The composite structure thus obtained may be wound up after cooling, or it may be guided as shown in FIG. 1, over further guide rolls 6 and 7 and in the region of the guide roll 6 an outer skin coating *ds* may be applied to the outer surface of the outer layer and then the composite structure may be passed through an additional oven IV in which the outer skin coating is dried and bonded to the outer layer and the thus-formed laminate is then after cooling guided over an additional guide roll 7 and then thereafter wound up. The skin coating may be formed from one of the liquid materials mentioned above for forming the barrier layer, respectively the outer layer.

The barrier layer *c* leaving the solvent removal zone or oven 1 may be still in tacky condition, or substantially dry and in the latter case an adhesive 5 of extremely small quantity in the order of 5 to 80 g/m² may be applied by the adhesive applicator indicated either to the barrier layer or to the carrier layer. Such an adhesive may be formed from one of the liquid materials as mentioned above for the formation of the barrier or the carrier layer.

Instead of using release surfaced paper which is continuously wound up from a supply roll and subsequently wound up on a wind-up roll, an endless release surfaced belt between the roll 2 and 3 may also be used. Such belts may, for instance, be formed from silicon rubber surfaced fabric belts or Teflon surfaced steel belts, however, at the present time the use of release surfaced paper is preferred for the temporary support.

The ovens used maybe circulating warm air type ovens such as for instance produced by Isotex SPA, Viconza, Italy. The ovens may have a length of approximately 36 feet and the ovens I, III and IV may be divided into three compartments in which, in the direction of material passing therethrough approximate temperatures of 150° F, 240° F and 300°–340° F, are maintained. In the interior of the oven II a temperature of approximately 220° F to 325° F is maintained. If the barrier layer *c* leaving the oven I is to be maintained in tacky condition, then the end temperature of this oven should be about 70° F to 300° F whereas if an adhesive film is interposed between the barrier layer and the carrier layer, then the end temperature in oven I should be increased to about 340° F in all oven zones, the temperatures may be adjustable beyond the cited typical limits, if required to suit the characteristics of the various solvent blends and coating formulations employed.

Figure 2:
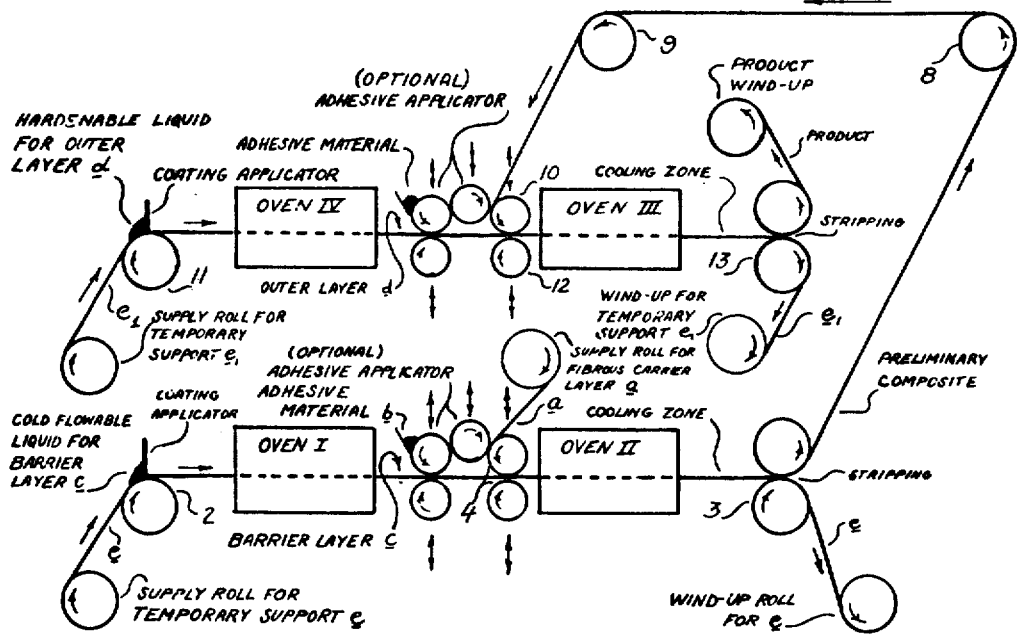

FIG. 2 illustrates an arrangement for carrying out the process according to the present invention in a second manner. In this process, as in the first-mentioned process, the barrier layer as well as the outer layer are formed from liquid films, but the process carried out with the arrangement shown in FIG. 2 differs from that carried out with the arrangement shown in FIG. 1 in that the liquid film from which the hardenable outer layer is formed is not directly applied to the free surface of the barrier layer in liquid form but first preformed into a substantially solid layer on a second temporary support.

The first portion of the arrangement shown in FIG. 2 is substantially identical to that shown in FIG. 1, that is a liquid film from which the barrier layer is to be formed is applied to the temporary support *e*, passed through the oven I and after the liquid film is transformed into substantially shape-retaining barrier layer, the carrier layer is applied thereto as described in connection with FIG. 1 and the composite structure is passed through the oven II where barrier and carrier layers are bonded to each other, and after which the preliminary composite composed of the barrier layer and a carrier layer, or an additional adhesive coating sandwiched therebetween, is passed in upward direction, then in a substantially horizontal direction and thereafter in downward direction over the guide rolls 8, 9 and 10. A second temporary support $e_1$ is unwound from a supply roll over the rolls 11, 12 and 13 and then wound up on a wind-up roll to form between the rolls 11 and 13-*a* horizontal portion in substantially taut condition. In the region of the guide roll 11 a film of one of the liquid materials mentioned above to form the outer layer therefrom is applied by the coating applicator shown to the second temporary support *e*, and this liquid film may be guided on this temporary support directly between the nip of the rolls 10 and 12 together with the preliminary composite passing downwardly over the roll 10 and from there through the oven III in which the liquid film *d* from which the outer layer is to be formed is hardened and bonded at the same time to the outer face of the barrier layer. The composite leaving the oven III is passed through a cooling zone and then the final product may be wound up as indicated.

Instead of feeding the material from which the outer layer is to be formed in substantially liquid condition into engagement with the barrier layer, it is also possible, as shown in FIG. 2, to pass this liquid film on the second temporary support first to an additional oven IV in which the liquid film is substantially hardened, and in this case an adhesive layer, of a material as mentioned before, is interposed between the substantially hardened outer layer and the outer face of the barrier layer before the layers are passed through the nip of the rolls 10 and 12. Such an adhesive layer is applied by the adhesive layer applicator indicated in FIG. 2.

The ovens shown in FIG. 2 are the same as described above in connection with FIG. 1 and the temperatures maintained therein are likewise substantially the same as described above.

Figure 3:
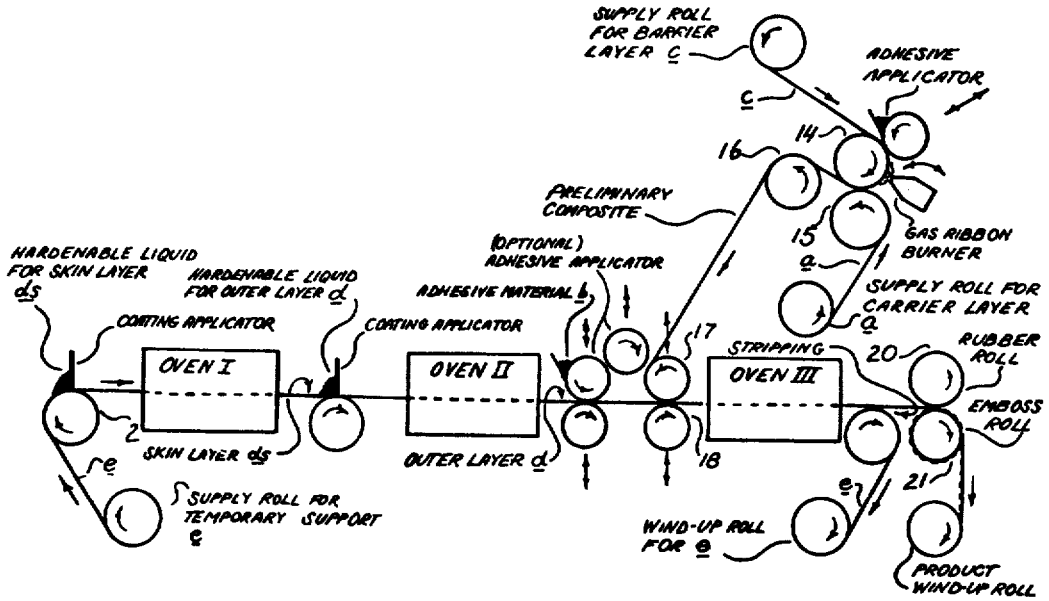

FIG. 3 illustrates a third arrangement for carrying out the process according to the present invention in a third manner. In the arrangement shown in FIG. 3, the outer layer is formed from a liquid film from one of the liquid materials mentioned above, whereas for the barrier layer an already pre-formed polyurethane barrier film or a layer of cellular foam from the material as described above is used, and this pre-formed barrier layer is unwound from a supply roll and guided over a guide roll 14 at which an adhesive layer made from the material as described above is applied to the outer face of the barrier layer or at which in case the barrier layer is a polyurethane foam, the barrier layer surface is softened and rendered molten through commonly known technique by heating it with a gas flame produced from a gas ribbon burner, after which the thus prepared barrier layer *c* is fed through the nip between the rolls 14 and 15 together with the carrier layer *a* which is unwound from a supply roll for such a carrier layer so that the two layers will be bonded to each other in the above-described manner. The thus produced preliminary composite of the barrier layer and the carrier layer bonded thereto with or without an adhesive layer sandwiched therebetween is guided over the guide roll 16 in downward direction to be passed through the nip between the rolls 17 and 18.

The outer layer *d* is in this case formed from a liquid film formed from one of the liquid materials mentioned above which is supported on a temporary carrier *e* arranged and continuously moved in horizontal direction as described in connection with FIG. 1. This liquid film on the temporary support *e* may be passed together with the preliminary composite formed by the barrier layer and the carrier layer in liquid form through the nip between the rolls 17 and 18 and then be passed through the oven III in which the outer layer is hardened and bonded at the same time to the outer surface of the barrier layer *c* to the other surface of which the carrier layer *a* is already bonded.

Instead of feeding the outer layer in the form of a liquid film or a liquid layer in engagement with the outer surface of the barrier layer *c*, the liquid film from which the outer layer is to be formed may first be passed while being supported on the temporary support *e*, through the oven II, shown in FIG. 3, to be substantially hardened therein and in this case an adhesive applicator has to be provided to apply an adhesive layer to the upper surface of the outer layer *d* or to the free surface of the barrier layer *c* before the outer layer and the barrier layer are passed through the nip between the rolls 17 and 18.

If it is desired to form on the final product an outer skin on the outer surface of the outer layer, as described in connection with FIG. 1, then a skin layer *ds* is first applied to the temporary support *e*, for instance in the region of the guide roll 2 thereof, and this outer skin layer is then passed through the oven I to be substantially hardened, whereafter the liquid film from which the outer layer is to be formed is applied to the free surface of the thus hardened skin layer *ds*.

Before the final product is wound up, the outer surface of the skin layer or the outer surface of the outer layer may be embossed by passing the composite product leaving the oven III between an embossing calender 20 and an embossing roll 21, as shown in FIG. 3, so that the final product will have a textured outer surface.

Figure 4:
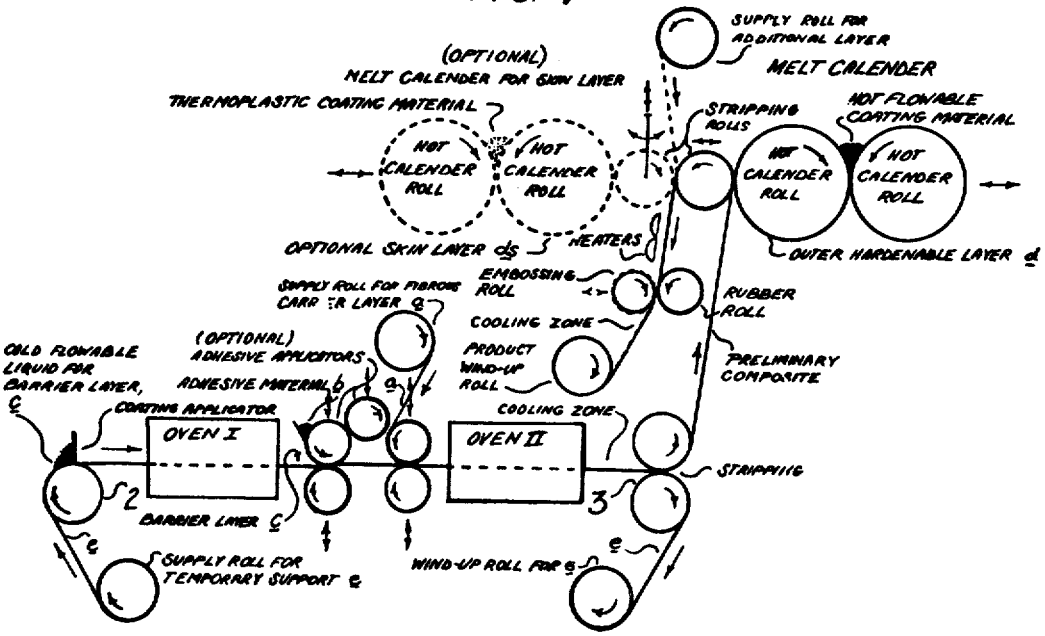

FIG. 4 illustrates a fourth arrangement for carrying out the process according to the present invention in a fourth manner.

In the arrangement shown in FIG. 4 the barrier layer is formed from a liquid film and applied to the temporary support *e* and thereafter bonded to the carrier layer of fibrous material in the same manner as described in connection with FIGS. 1 and 2. The outer layer in this case is, however, not formed from a liquid film but from a hot flowable thermoplastic material, examples of which are described above, which is passed through the nip of a pair of hot calender rolls of a melt calender and the outer hardenable layer *d* thus produced is guided together with the preliminary composite including the barrier layer and carrier layer, or in addition an adhesive layer sandwiched therebetween, over the stripping roll shown in FIG. 4 in which the outer hardenable layer *d* is applied and bonded to the outer surface of the barrier layer.

If desired, an outer skin coating or skin layer *ds* may also in this case be applied to the outer surface of the outer layer *d*, and as shown in FIG. 4 the outer skin layer may also be produced by hot calendering a thermoplastic material between an additional pair of hot calender rolls as indicated in dotted lines in FIG. 4 and the skin layer *ds* thus produced may be passed over an additional stripping roll, likewise shown in dotted lines in FIG. 4 and thus be applied to the outer surface of the outer hardenable layer *d*. If desired, an additional layer may be sandwiched between the outer skin layer *ds* and the outer hardenable layer *d*, as likewise indicated in dotted lines in FIG. 4. The thus produced product may be directly wound up or be passed between the nip of an embossing roll and a rubber roll to provide an embossed surface on the final product.

Figure 5:
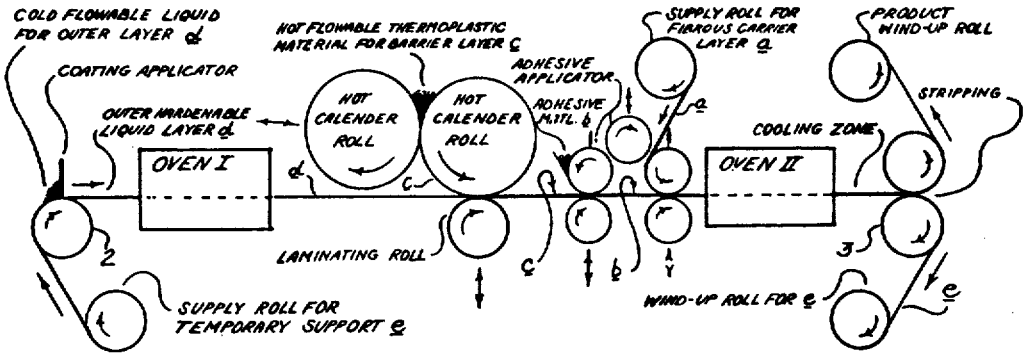

FIG. 5 illustrates a fifth arrangement for carrying out the process according to the present invention in a fifth manner. In this case the outer layer is formed from a liquid film of a material as described above, whereas the barrier layer *c* is formed from thermoplastic material as described above which lends itself to hot calendering.

As shown in FIG. 5, the outer layer is applied in liquid form to the release surfaced temporary support *e*, arranged and continuously moved as described in connection with FIG. 1, in the region of the guide roll 2 which supports the temporary support of the left end thereof, as viewed in FIG. 5. This liquid film formed from material as described above is passed through the oven I in which it is transformed into a substantially hardened layer *d* which forms in the final product the outer layer. The barrier layer *c* is then applied to the outer surface of the thus formed layer *d* and the barrier layer *c* is formed in this case by passing a thermoplastic material as described above between hot calender rolls as shown in FIG. 5, whereby the right one of the pair of hot calender rolls, as viewed in FIG. 5 applies the barrier layer *c* in tacky condition to the upper surface of the layer *d*. After the layer *c* has cooled and substantially hardened, an adhesive coating of the material as described above is applied to the outer surface of the barrier layer *c* by a coating knife or by a roller coater, as indicated in FIG. 5, whereafter the fibrous carrier layer *a*, unwound from a supply roll, is applied to this adhesive coating, whereafter the superimposed layers are passed through the oven II in which the layers are finally bonded together. The thus produced product is then stripped from the temporary support *e* and wound up. It is evident that before winding up the product may be passed between the nip of an embossing calender roll and an embossing roll so as to provide a textured outer surface to the product, as described above in connection, for instance, with FIG. 3.

It is also evident that the arrangement shown in FIG. 5 may be modified to provide an outer skin coating to the outer layer, in which case the temporary support *e* would have to be extended towards the left, as viewed in FIG. 4, and an applicator for an outer skin coating *ds* and an additional oven would have to be provided, as described in connection with FIG. 3.

Figure 6:
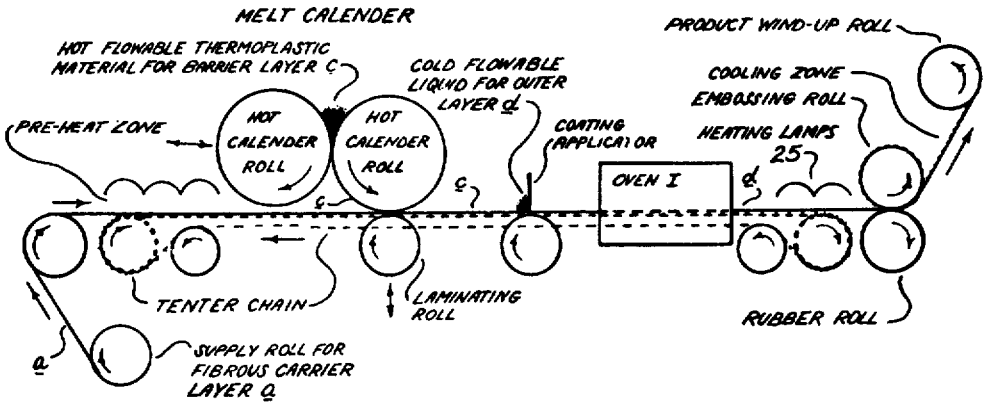
Figure 7:
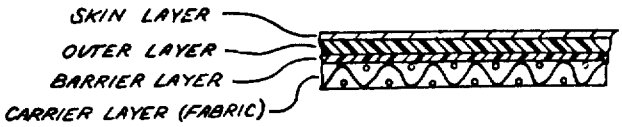
FIG. 7 is an enlarged cross-sectional view of an example of a laminated structure produced according to the method of the present invention.

Finally, FIG. 6 illustrates a sixth arrangement for carrying out the process according to the present invention in a sixth manner.

In the arrangement as shown in FIG. 6 no separate temporary support such as those shown in FIGS. 1–5 is used for supporting any of the layers of which the final product is composed. Furthermore, in the arrangement shown in FIG. 6 the barrier layer is produced by hot calendering from thermoplastic material, as mentioned above, whereas the outer layer *d* is produced from a liquid film from one of the liquid materials likewise mentioned above. However, the calender roll which transports the freshly-formed film of the thermoplastic material for the barrier layer *c* constitutes a moving temporary support for a brief period. In this case the barrier layer *c* is first applied and bonded to the carrier layer *a* whereafter the outer layer is applied in the form of a liquid film of hardenable material to the free surface of the barrier layer *c*.

The carrier layer *a* unwound from a supply roll is preferably moved and supported in horizontal direction by means of a driven tenter chain of known construction so as to be held in taut condition during its movement in horizontal direction. The fabric layer *a* is preheated in a pre-heat zone indicated in FIG. 6 and the barrier layer *c* formed in a melt calender by passing a thermoplastic material as described above between a pair of hot calender rolls is then applied to the upper surface of the pre-heated fabric layer or carrier layer by passing the two layers between the nip of the right hot calender roll as shown in FIG. 6 and a laminating roll located therebeneath so that the barrier layer *c* is bonded to the carrier or fabric layer *a* in the manner as described above, that is so that the barrier layer will adhere firmly to the projections on the upper face of the carrier layer without substantially filling the recessed portions of the latter. After the barrier layer has cooled during the further movement thereof toward the right, as viewed in FIG. 6, a liquid layer from a material as described above for forming the outer layer *d* is then applied, by the coating applicator shown, to the outer surface of the barrier layer, whereafter the superimposed layers are passed through the oven I, the interior of which is maintained at a temperature of substantially 200°380° F so that the outer layer applied in liquid form to the barrier layer is hardened and bonded to the latter.

The product leaving the oven I may be directly wound up after cooling, or the laminated product may again be slightly heated, for instance by heating lamps 25, indicated in FIG. 6, whereafter the reheated product is passed between the nip of an embossing roll and an opposite rubber roll so that the outer layer may be embossed, as shown in FIG. 6, whereafter the product is then wound up.

It is evident that also with the arrangement shown in FIG. 6, the final product may be provided with an outer skin coating in which case a coating applicator and an additional oven has to be provided downstream of the oven shown for applying an outer skin layer in the form of a liquid film to the outer surface of the hardened outer layer after the latter has been hardened and bonded to the barrier layer.

It is to be understood that in all processes disclosed, whenever the liquid material used to form the cold flowable liquid barrier layer, the hardenable liquid outer layer or the skin layer contains either a prepolymer like that of polyurethane of the moisture curing type or a lacquer containing a fully reacted solvent soluble resin like polyurethane in a proportion of a water miscible solvent like DMF (dimethylformaide), for example, the thin layer of liquid material which is applied to form the barrier or outer layers may be partially coagulated, gelled or hardened by atmospheric or intentionally introduced moisture and coincidentally a portion of the water miscible solvent may be removed and even subsequently recovered from water which may be applied to the mentioned coated liquid layer in the form of steam, water sprays or immersion baths, for example, optionally interposed within the sequence of the above mentioned processes in the region following the appropriate liquid coating applicator and prior to the subsequent drying oven.

It is also to be understood that in all processes disclosed, regardless of the sequence in which the layers are bonded to each other and regardless of whether the barrier layer is formed during the process from a liquid film into a substantially shape-retaining barrier layer or whether an already pre-formed barrier layer is used in the process, the barrier layer has to be bonded to the face of the carrier layer which is provided with projecting and recessed portions in such a manner that the barrier will adhere substantially to the projecting portions without filling the recessed portions. By bonding the barrier layer in this way to the carrier layer and by sandwiching the barrier layer between the carrier layer and the outer layer a vary pliable composite structure is produced.

The barrier layer or barrier film is formed, as described above, from a layer of film or liquid material. The barrier layer used has a thickness which is smaller than that of the carrier layer and generally smaller than that of the outer layer, usually in the order of 0.0002 to 0.0003 inches. This small thickness and the adjusted viscous flow of the barrier layer, when applied to the carrier, limits the depth of possible penetration of the carrier surface fibers, yarn crowns and projections into the essentially shape retaining barrier layer. Thus, the barrier layer cannot excessively penetrate or inhibit drape and flexible mobility of the fiberous structure and by controlled regulation of thickness, viscosity and process conditions, only sufficient contact is allowed between the outermost fibers or yarn structure of the carrier and the essentially shape retaining barrier layer to result in firm bonding between these laminated layers.

Despite its very small thickness after being bonded to the carrier layer, this interposed membrane layer is at least a temporary barrier and will serve so until solidification of the outer hardenable layer, to prevent penetration of the material of the outer layer into the textile material forming the carrier layer, even if the outer layer has a thickness considerably greater than the barrier layer and is applied in liquid form against the outer surface of the latter. Therefore, regardless of whether the material of the outer and the barrier layer are essentially similar or dissinilar in composition, application of the two distinctly separate layers, a barrier layer and an outer layer, is required to achieve the desired results.

When the materials of the barrier and outer layers are similar, a proportion of diluents or solvents less active than the primary solvents are preferred for the liquid phase of the outer layer to inhibit attack or premature penetration of the pre-formed barrier layer. For example, if a common polyurethane resin is used for both the barrier and the cuter layers of a product, a typical formulation amongst many possible combinations may be:

| Barrier Layer | | |
|---|---|---|
| parts by weight | | |
| 22.0 | Estane 5707 F — | B. F. Goodrich |
| 3.0 | Pigment ($TiO_2$) — | E. I. DuPont |
| 80.0 | DMF Dimethylformamide — | E. I. DuPont |
| Outer Layer | | |
| parts by weight | | |
| 22.0 | Estene 5707 F | |
| 3.0 | Pigment | |

-continued

| | |
|---|---|
| 15.0 | DMF |
| 15.0 | MEK |
| 35.0 | Toluene |

When the materials of composition of the barrier and the outer layers are essentially dissimilar but compatible, a selected cross-linking agent or adhesion promoter is preferably included in the formulation. For example, if the barrier layer is a polyurethans, the outer layer is a PVC plastisol and the skin layer is another polyurethane, a typical formulation amongst many possible combinations may be:

| | | | |
|---|---|---|---|
| Barrier Layer | (polyurethane- two component type) | | |
| parts by weight | | | |
| 100.0 | Deltoflex 1S, | — | I.C.I. America, Inc. |
| 22.5 | Suprasec G | — | I.C.I. America, Inc. |
| 7.5 | Daltrol PR1 | — | I.C.I. America, Inc. |
| 300.0 | Ethyl Acetate | | |
| 1.5 | Silane A-1100 | — | Union Carbide Corp. |
| Outer Layer | (vinyl plastisol with cross-linking agent) | | |
| parts by weight | | | |
| 100.0 | Geon 120X222 - | | B.F. Goodrich Chemical |
| 6.0 | Bonding Agent TN- | | Verona Dyestuffs Co. |
| 50.0 | DOP (dioctylphthalate) | | |
| 25.0 | DDA | | (dodecyladipate) |
| 15.0 | BBP (butylbenzylpthalate) | | |
| 5.0 | 6-62 | — | Rohm & Haas |
| 1.5 | Silane A-1100 | — | Union Carbide Corp. |
| 7.0 | Pigment/Filler, $TiO_2$ | | |
| Skin Layer | (polyurethane- two component type) | | |
| parts by weight | | | |
| 250.0 | Impranil O - | | Verona Dyestuffs Co. |
| 25.0 | Pigment/filler, $TiO_2$ | | |
| 400.0 | MEK, methyl ethyl ketone | | |
| 250.0 | Toluene | | |
| 41.25 | Imprafix TH- | | Verona Dyestuffs Co. |
| 41.25 | Imprafix BE- | | Verona Dyestuffs Co. |
| 3.0 | Silane A-1100- | | Union Carbide Corp. |

An exception of the extremely small thickness of the barrier layer is the case in which the latter is used in the process as an already preformed sheet as described above in connection with FIG. 3, especially if copolyurethane foam sheet is used for the barrier layer, which may have, as mentioned above, a relatively large thickness, but only the outermost cells are softened and molten in the commonly known flame lamination process, therefore this material likewise does not fill the structural interstices of the fiberous carrier when contacted and laminated thereto.

In all examples cited above, a definite thickness of tacky or softened material, which is relatively much thinner than the fiberous carrier layer, is available on the contacting surface between the pre-formed barrier layer and the carrier layer at time of lamination and this thickness essentially limits the degree of possible penetration of the tacky layer into the interstices and structural voids of the fiberous carrier layer. Otherwise, if the carrier layer was to be directly laminated to the liquid material of the relatively thick outer layer, attainment of a reproducible and uniformly proper level of adhesion between the layers, while limiting penetration of the liquid material of the outer layer into the voids and intersitces of the fiberous carrier layer, would be critical and unreliable with indefinite control of variable parameters of flow, viscosity, rheology, consistency and tackiness or by mechanical means like use of a single dip roll, in place of the laminating nip set, where the single dip roll is pressed against the tension of the taught support or carrier layer to laminate the layer, or by use of a precisely adjusted gap and pressure between the laminating nip rolls, all of these means being indefinite when the outer liquid layer is of variable consistency and the fiberous carrier has the normal thickness variations of a textile material. It will now be understood that all of these above mentioned viscosity controls, adjustments or mechanical variations may certainly be used as aids to properly join the carrier and barrier layers in combination with or in place of the lamination roller nips shown in FIGS. 1,2,3,4,5,6 but such adjustments to control penetration and adhesion are not so critical or indefinite, in this event, due to the inherent limitations on penetration as imposed by the relatively small thickness of the softened or tacky material when a barrier layer of the preferred thickness is sandwiched between the carrier and the outer layers.

Without further analysis, the foregoing will so fully reveal the gist of the present invention that others can, by applying current knowledge, readily adapt it for various applications without omitting features that, from the standpoint of prior art, fairly consitute essential characteristics of the generic or specific aspects of this invention and, therefore, such adaptations should and are intended to be comprehended within the meaning and range of equivalence of the following claims.

What is claimed as new and desired to be secured by Letters Patent is set forth in the appended claims:

1. A method of forming a flexible artificial leather product comprising the steps of:

forming a synthetic resinous intermediate layer on a moving temporary support having a surface of predetermined smoothness thereby forming the surface of said intermediate layer contacting said support to said predetermined smoothness, said intermediate layer which, when solidified, is substantially impervious to penetration by preselected outer layer materials and is adherent to a fibrous substrate and an outer layer after solidification;

then moving a fibrous substrate having interconnecting interstices throughout its body into contact with the exposed surface of said intermediate layer on said moving temporary support while at least the exposed surface of said intermediate layer is in a formable condition;

then pressing said intermediate layer on said temporary moving support into said fibrous substrate to force said intermediate layer into the surface of said substrate while preventing the intermediate layer from substantially filling the interstices throughout the substrate;

solidifying said intermediate layer, while maintaining said first named surface at said predetermined smoothness, to adhere said exposed surface of said intermediate layer to said substrate and thereby prevent the interstices of said substrate from being filled by subsequent layers coated onto the smooth first names surface of said intermediate layer;

separating said temporary support and said intermediate layer, said separating and solidifying steps occurring in any desired sequence;

forming a synthetic resinous outer layer capable of solidifying into a flexible, water vapor permeable layer on the smooth first named surface of said intermediate layer; and solidifying said outer layer to form a flexible, water vapor permeable outer layer adhering to the smooth first named surface of said intermediate layer.

2. A method of forming an artificial leather as in claim 1 wherein the top surface of said outer layer is of predetermined smoothness.

3. A method for forming an artificial leather as defined in claim 1 wherein both said substrate and said outer layer are substantially thicker than said intermediate layer.

4. A method of forming an artificial leather as defined in claim 3 wherein said intermediate layer is water vapor permeable after it has been solidified.

5. A method of forming an artificial leather as defined in claim 3 wherein said smooth temporary support is removed after said intermediate layer is solidified.

6. A method of forming an artificial leather as in claim 5 wherein said substrate is a bonded, needle-punched, non-woven fabric substrate having a plurality of interconnecting interstices throughout and extending to both surfaces, and said intermediate layer comprises a polyurethane resin mixed with a solvent thereof 7. A method of forming an artificial leather as in claim 3 wherein said smooth temporary support is removed before said intermediate layer is solidified.

8. A method for forming an artificial leather as in claim 7 wherein said intermediate layer is a thermoplastic material and said forming includes:

raising said thermoplastic material to a temperature where it assumes a formable condition.

* * * * *